US008113892B1

(12) United States Patent
Gable et al.

(10) Patent No.: US 8,113,892 B1
(45) Date of Patent: Feb. 14, 2012

(54) STEERING CONTROL SYSTEM FOR A WATERCRAFT WITH THREE OR MORE ACTUATORS

(75) Inventors: Kenneth G. Gable, Oshkosh, WI (US); Jason S. Arbuckle, Horicon, WI (US)

(73) Assignee: Brunswick Corporation, Lake Forest, IL (US)

( * ) Notice: Subject to any disclaimer, the term of this patent is extended or adjusted under 35 U.S.C. 154(b) by 354 days.

(21) Appl. No.: 12/418,653

(22) Filed: Apr. 6, 2009

(51) Int. Cl.
*B63H 21/21* (2006.01)

(52) U.S. Cl. ..... 440/84; 114/144 RE; 440/1

(58) Field of Classification Search ..... 114/144 R, 114/144 RE; 440/1, 84; 701/21
See application file for complete search history.

(56) References Cited

U.S. PATENT DOCUMENTS

| | | | | |
|---|---|---|---|---|
| 6,273,771 | B1 | 8/2001 | Buckley et al. | |
| 6,485,340 | B1 | 11/2002 | Kolb et al. | |
| 6,583,728 | B1 | 6/2003 | Staerzl | |
| 6,587,765 | B1 | 7/2003 | Graham et al. | |
| 7,036,445 | B2 | 5/2006 | Kaufmann et al. | |
| 7,121,908 | B2 | 10/2006 | Okuyama | |
| 7,150,240 | B2 | 12/2006 | Gillman et al. | |
| 7,188,581 | B1 | 3/2007 | Davis et al. | |
| 7,325,505 | B2 | 2/2008 | Otobe et al. | |
| 7,371,140 | B2 | 5/2008 | Davis | |
| 7,387,556 | B1 | 6/2008 | Davis | |
| 7,404,369 | B2 | 7/2008 | Tracht et al. | |
| 7,429,202 | B2 | 9/2008 | Yazaki et al. | |
| 7,438,013 | B2 * | 10/2008 | Mizutani | 114/144 RE |
| 7,467,981 | B2 | 12/2008 | Okuyama et al. | |
| 2006/0014447 | A1 * | 1/2006 | Okuyama | 440/84 |
| 2006/0240720 | A1 * | 10/2006 | Yamashita et al. | 440/1 |

* cited by examiner

*Primary Examiner* — Lars A Olson
(74) *Attorney, Agent, or Firm* — William D. Lanyi

(57) ABSTRACT

A marine propulsion control system receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

20 Claims, 7 Drawing Sheets

BOAT SPEED (MPH)

| WHEEL ROTATION (DEGREES) | 0 | 10 | 20 | | 40 |
|---|---|---|---|---|---|
| 0 | | | | | |
| 20 | | | | | |
| | | | | | |
| | | | | | |
| | | | | | |
| | | | | | |
| | | | | | |
| | | | | | |
| 160 | | | | | |
| 180 | | | | | |

STEERING CONTROL SYSTEM FOR A WATERCRAFT WITH THREE OR MORE ACTUATORS

CROSS REFERENCE TO RELATED APPLICATIONS

The present application is related to patent application Ser. No. 12/418,657 which was filed on the same date as the present application.

BACKGROUND OF THE INVENTION

1. Field of the Invention

The present invention is generally related to control systems for watercraft and, more particularly, to a control system in which multiple actuators, such as steering actuators or trim plate actuators, are controlled in response to manual commands which emanate from a number of sensors or switches that is less than the number of actuators being controlled.

2. Description of the Related Art

Those skilled in the art of marine propulsion systems and, more particularly, steering systems and trim systems associated with marine vessels, are familiar with many different devices, systems, and techniques associated with the control of a marine vessel. This knowledge includes various types of communication systems on a marine vessel and various techniques for controlling a plurality of devices, such as steering actuators, with a number of sensors or switches that is less than the number of actuators being controlled.

U.S. Pat. No. 6,273,771, which issued to Buckley et al. on Aug. 14, 2001, discloses a control system for a marine vessel. It incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,485,340, which issued to Kolb et al. on Nov. 26, 2002, describes an electrically controlled shift and throttle system. It is intended for a watercraft having multiple control stations. The system has a number of control units having an elongated lever arm which can be moved in forward and reverse directions for shifting the transmission among forward, neutral, and reverse operating modes, as well as controlling the throttle of the engine for varying the operating speed thereof. The control units are electrically connected to a controller which also is electrically connected to a shift gear motor and throttle motor. Switches associated with each of the control units enable one of the control units to be selected as a master control unit and the non-selected control units then operate as slave units.

U.S. Pat. No. 6,583,728, which issued to Staerzl on Jun. 24, 2003, discloses a trim tab position monitor. A circuit is provided which receives a signal that is representative of a voltage potential across a stator winding of a motor which is attached to the trim tab. This signal is passed through a high pass filter to remove the DC component of the signal, amplified, and passed through a low pass filter to remove certain high frequency components of the signal. A zero crossing detector is used to discern individual pulses which are then received by a counter that provides a single output pulse for a predetermined number of input pulses.

U.S. Pat. No. 6,587,765, which issued to Graham et al. on Jul. 1, 2003, describes an electronic control system for marine vessels. It has one or more engines and a transmission associated with each engine and it includes one or more control stations. Each station has a control arm. The system includes one or more electronic control units, each of which is electromechanically coupled to an engine and a transmission.

U.S. Pat. No. 7,036,445, which issued to Kaufmann et al. on May 2, 2006, describes a watercraft steer-by-wire system. It comprises a direction control system including a rudder position sensor, a helm control system including at least one of a helm position sensor to produce and transmit a helm position signal and an optional torque sensor to produce and transmit a helm torque sensor signal. The system optionally includes a watercraft speed sensor and a master control unit in operable communication with the watercraft speed sensor, the helm control system, and the direction control system.

U.S. Pat. No. 7,121,908, which issued to Okuyama on Oct. 17, 2006, describes a control system for watercraft propulsion units. Shift and thrust of outboard motors can be controlled through adjacent two operating levers in the watercraft having three or more outboard motors mounted in parallel on a transom plate. The control system can be provided with a control circuit for detecting lever positions of the operating levers and controlling the left unit according to the position lever of the left operating lever and the right unit according to the lever position of the right operating lever. The control circuit can be provided with a calculation circuit for calculating an imaginary lever position of the middle unit from the lever positions detected.

U.S. Pat. No. 7,150,240, which issued to Gillman et al. on Dec. 19, 2006, describes a method and apparatus for maneuvering a watercraft. A watercraft steer-by-wire control system comprises an input device, at least one transducer in operable communication with the input device, a rudder control system in operable communication with the input device and configured to control a rudder of a watercraft, and a bow thruster control system in operable communication with the one transducer and configured to control a bow thruster of the watercraft.

U.S. Pat. No. 7,188,581, which issued to Davis et al. on Mar. 13, 2007, discloses a marine drive with an integrated trim tab. The marine drive and a marine vessel and drive combination have a trim tab with a forward end pivotally mounted to a marine propulsion device.

U.S. Pat. No. 7,325,505, which issued to Otobe et al. on Feb. 5, 2008, describes an outboard motor steering control system. In an outboard motor steering control system having a plurality of outboard motors, each adapted to be mounted on a stern of a boat by a shaft to be movable by an actuator relative to the boat and each having an internal combustion engine to power a propeller, a desired steering angle of each outboard motor is determined individually based on detected engine speed and rotation angle of a steering wheel. The operation of the actuator is controlled based on the determined desired steering angle, thereby improving both straight course-holding performance and turning performance by regulating the relative angles between the outboard motors in response to the cruising conditions of the boat.

U.S. Pat. No. 7,371,140, which issued to Davis on May 13, 2008, discloses a protective marine vessel and drive. The vessel and drive combination includes port and starboard tunnels formed in a marine vessel hull raising port and starboard steerable marine propulsion devices to protective positions relative to the keel.

U.S. Pat. No. 7,387,556, which issued to Davis on Jun. 17, 2008, discloses an exhaust system for a marine propulsion device having a driveshaft extending vertically through a bottom portion of a boat hull. The exhaust system directs a flow of exhaust gas from an engine located within the marine vessel and preferably within a bilge portion of the marine vessel through a housing which is rotatable and supported below the marine vessel. The exhaust passageway extends through an interface between stationary and rotatable portions of the marine propulsion device, through a cavity formed in the housing, and outwardly through hubs of the pusher propellers to conduct the exhaust gas away from the propellers without causing a deleterious condition referred to as ventilation.

U.S. Pat. No. 7,404,369, which issued to Tracht et al. on Jul. 29, 2008, describes a watercraft steer-by-ireless system. It includes a directional control system responsive to a directional command signal for steering a watercraft, the directional control system including a rudder position sensor to measure and transmit a rudder position signal, and a helm control system responsive to a helm command signal for receiving a directional input to a helm control unit from an operator.

U.S. Pat. No. 7,429,202, which issued to Yazaki et al. on Sep. 30, 2008, describes an outboard motor control system. In a system having two outboard motors each mounted on a stern of a boat, there is provided a controller that controls operation of steering actuators to regulate steering angles of the outboard motor such that lines extending from the axes of rotation of the propellers of the outboard motors intersect at a desired point. With this, it becomes possible to freely adjust the stream confluence point of the outboard motors, thereby improving both driving stability and providing enhanced auto-spanker performance.

U.S. Pat. No. 7,467,981, which issued to Okuyama et al. on Dec. 23, 2008, describes a remote control device and watercraft. In a watercraft equipped with at least three outboard motors the remote control device can be used. It can have a pair of shift levers and can be provided with a detection device for protecting positions of the shift levers. A remote control side ECU can control the outboard motors by signals from the detection device. The remote control side ECU can include a plurality of ECUs corresponding to the outboard motors.

The patents described above are hereby expressly incorporated by reference in the description of the present invention.

It would be significantly beneficial if a system could be provided in which sensors and/or switches associated with manually operated devices could provide signals to a plurality of controllers so that those controllers could control the operation of a plurality of actuators in a way which does not require each of the controllers to be directly connected to one or more of the sensors and/or switches. It would also be desirable to provide a system in which one of the controllers could receive the signals from the sensors and/or switches and then communicate those signals to other controllers. It would also be beneficial if a system could be developed that provides redundancy in the event that one or more of the sensors and/or switches become inoperable for any reason.

SUMMARY OF THE INVENTION

A marine propulsion control system made in accordance with a preferred embodiment of the present invention comprises a manually operable device, a first sensor or switch configured to detect or correspond to a position of the manually operable device and provide a first signal which is representative of the position of the manually operable device, a first actuator, a second actuator, and a third actuator, and a first controller connected in signal communication with the first actuator, a second controller connected in signal communication with the second actuator, and a third controller connected in signal communication with the third actuator. The manually operable device can be a hand operated steering wheel, a plurality of manually manipulated trim switches, or any other device which are moved by an operator of a marine vessel and cause a plurality of actuators to move in response to those commands. A preferred embodiment of the present invention is particularly suitable for use in situations where the number of actuators exceeds the number of switches or sensors. The first, second and third actuators can be steering actuators such as hydraulic actuators which cause a marine propulsion device to rotate about a generally vertical steering axis or, alternatively, trim actuators, such as hydraulic cylinders, which cause trim plates to move in response to commands received from one or more trim switches. An important feature in a preferred embodiment of the present invention is that the number of sensors or switches that are manipulated by the operator of the marine vessel is less than the number of actuators that are caused to move in response to the receipt of signals from the one or more switches or sensors. In a preferred embodiment of the present invention, the first controller is configured to receive the first signal and provide control signals to the second and third controllers in response to receipt of the first signal from the first sensor or switch.

As described above, the actuators can be steering actuators or trim position actuators. In one of the preferred embodiments of the present invention which is used in conjunction with a steering system, the first actuator is configured to cause an outside port propulsion drive to rotate about a first generally vertical steering axis, the second actuator is configured to cause an outside starboard propulsion drive to rotate about a second generally vertical steering axis, and the third actuator is configured to cause an inside starboard propulsion drive to rotate about a third generally vertical steering axis.

Throughout the description of the various embodiments of the present invention, certain conventions will be adopted herein to describe the devices that are controlled or actuated. When four such devices are used, such as four propulsion drive units, four steering actuators, or four trim actuators, the device on the far left of the four is referred to as the port outside device and the device at the opposite end of the group of four is referred to as the starboard outside device. The two devices between the port outside device and starboard outside device are identified as the port inside device and starboard inside device. Starting at one end of the arrangement of four devices, in order, the devices are therefore identified in this description by the terms port outside device, "port inside device", starboard inside device, and starboard outside device. When only three such devices are used in an embodiment of the present invention, the center device is referred to as the "inside starboard device". The description of the preferred embodiment of the present invention could alternatively have referred to this center device as the port inside device, but for consistency the center device will be referred herein to as the starboard inside device. This terminology is adopted regardless of whether the present invention is used in a steering application, a trim plate control application or other type of application.

In order to distinguish the various devices according to their position, they may also identified as first, second, and third devices. For example, the controllers used in a preferred embodiment of the present invention when three propulsion drives are provided on a marine vessel, can be identified as the first, second, and third controllers. In this case, the term "first controller" is used to describe the controller used in association with the starboard outside propulsion unit. The term "second controller" is associated with the port outside propulsion unit, and the "third controller" is used in conjunction with the starboard inside controller which, when only three propulsion drives are used, is located between the port outside drive and the starboard outside drive, as described above. This is true whether the preferred embodiment of the present invention is being described in conjunction with a steering application, a trim plate control application or otherwise.

In some applications of the present invention, the second controller is configured to receive the first signal in parallel with that signal being received by the first controller. In certain embodiments of the present invention, the second controller is configured to receive the first signal and provide a control signal to the third controller in response to receipt of the first signal from the first sensor, such as a rotation sensor associated with a steering wheel or a trim switch. The third controller is configured to alternatively receive control signals from the first and second controllers. In a particularly preferred embodiment of the present invention, the first, second, and third controllers are all connected in signal communication with a common signal bus such as a serial communication bus. In a preferred embodiment of the present invention, the third controller is configured to control the third actuator in conformance with the control signals which are derived as a function of the first signal in conformance with which the first actuator is controlled by the first controller.

In a preferred embodiment of the present invention, it is not necessary that all of the controllers receive signals directly from the sensor or switch that is associated with a manually operated device, such as the steering wheel or trim switches. Instead, preferred embodiments of the present invention are configured in a way that connects the signal from the sensor or switch to one of the controllers and that controller, after receiving the first signal, provides signals to the other controllers. This is usually done on the serial communication bus, but alternative embodiments are also within the scope of the present invention. Furthermore, in certain embodiments of the present invention, alternative sensors and/or switches are provided in parallel with a primary sensor or switch. This redundancy is intended to be particularly useful if the primary sensor or switch fails or becomes inoperable for any reason. Since preferred embodiments of the present invention are intended for use with marine vessels, it is important to provide redundancy, particularly in applications relating to the steering system of a marine vessel.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
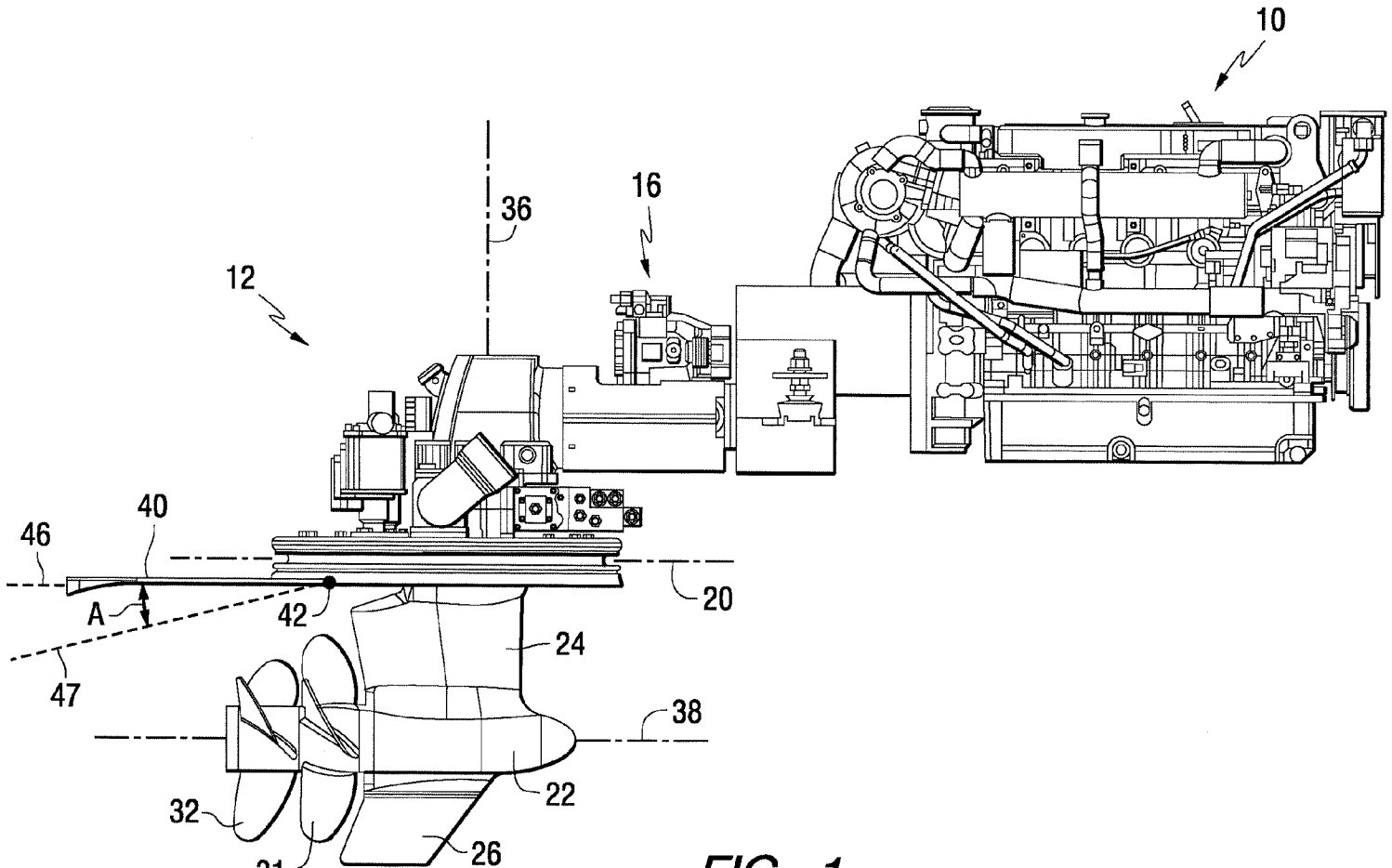
FIG. 1 is a side view of a marine propulsion unit.

Throughout the description of the preferred embodiment of the present invention, like components will be identified by like reference numerals.

Preferred embodiments of the present invention are particularly adaptable for use in marine propulsion systems that incorporate a plurality of marine drives such as the system described in U.S. Pat. No. 7,121,908 and cited above. In addition, certain embodiments of the present invention are particularly advantageous when used in marine propulsion systems such as those described in U.S. Pat. Nos. 7,188,581 and 7,371,140. Those two patents and U.S. Pat. No. 7,387,556 describe in detail a type of marine propulsion system that incorporates a plurality of marine propulsion units that extend through the hull of a marine vessel. Preferred embodiments of the present invention will be described herein in conjunction with that particular type of marine propulsion system.

FIG. 1 is a side view of a marine propulsion system that comprises an engine 10, a propulsion drive unit 12 and various hydraulic valves and actuators 16. Dashed line 20 represents the location of the bottom surface of the hull of a marine vessel. The gear case 22 and driveshaft housing 24 extend through the hull and are located below the marine vessel. The driveshaft housing 24, gear case 22, skeg 26, and propellers 31 and 32 are rotatable about a generally vertical steering axis 36. The propellers, 31 and 32, are connected to a propeller shaft which is supported for rotation about the generally horizontal axis 38. In the particular propulsion system shown in FIG. 1, a trim plate 40 is attached directly to the marine propulsion unit 10 and is rotatable about a generally horizontal axis 42. Dashed lines 46 and 47 represent the exemplary limits of travel of the trim plate 40 which is identified by reference letter A in FIG. 1. It should be understood that, although a preferred embodiment of the present invention relating to trim plate control is described herein in relation to a system in which the trim plate 40 is attached to the drive unit 12, alternative embodiments of the present invention could attach the trim plates, or trim tabs, directly the marine vessel and not to the propulsion unit itself.

Figure 2:
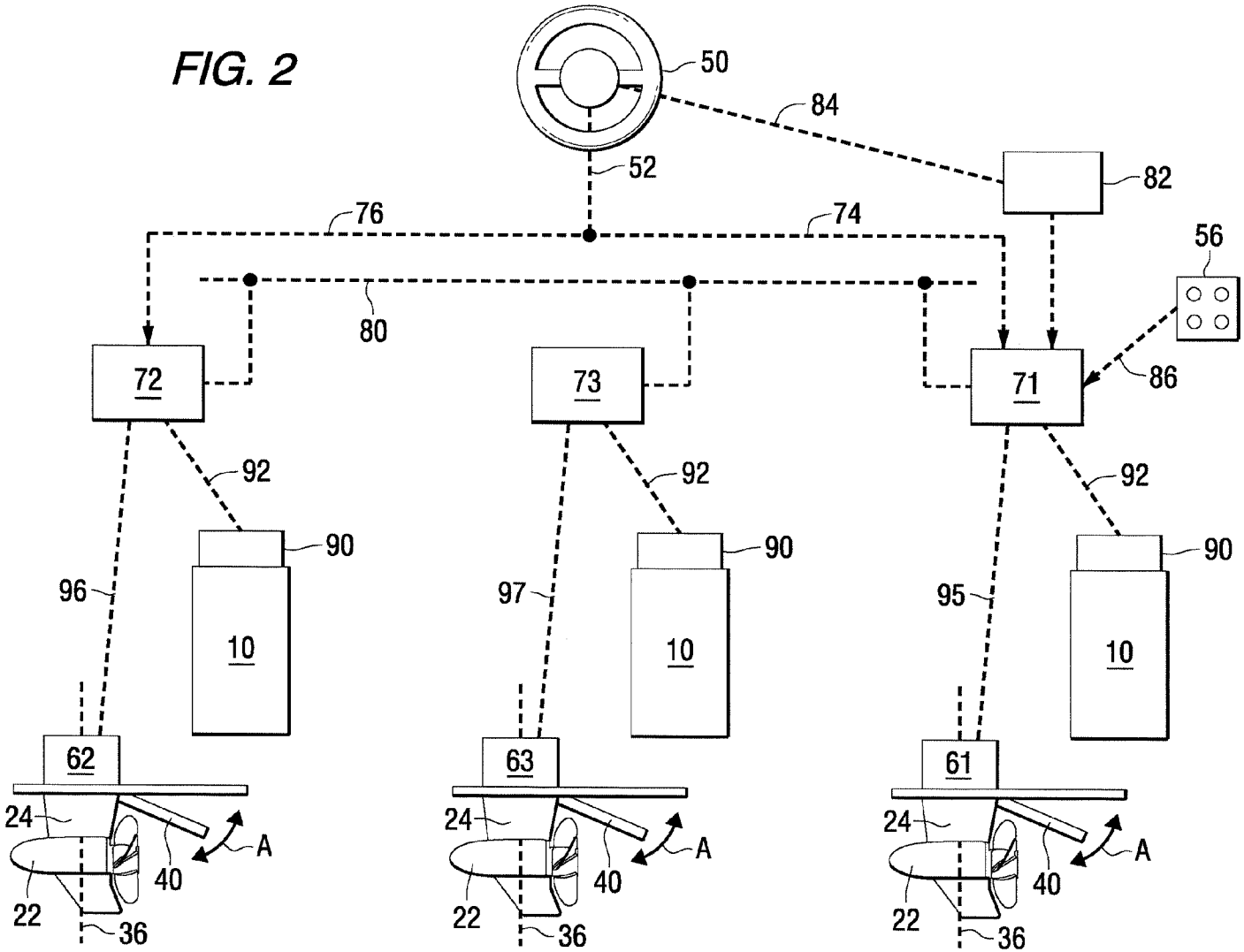
FIGS. 2 and 3 are simplified representations of a marine propulsion system utilizing three propulsion units similar to that shown in FIG. 1.
Figure 3:
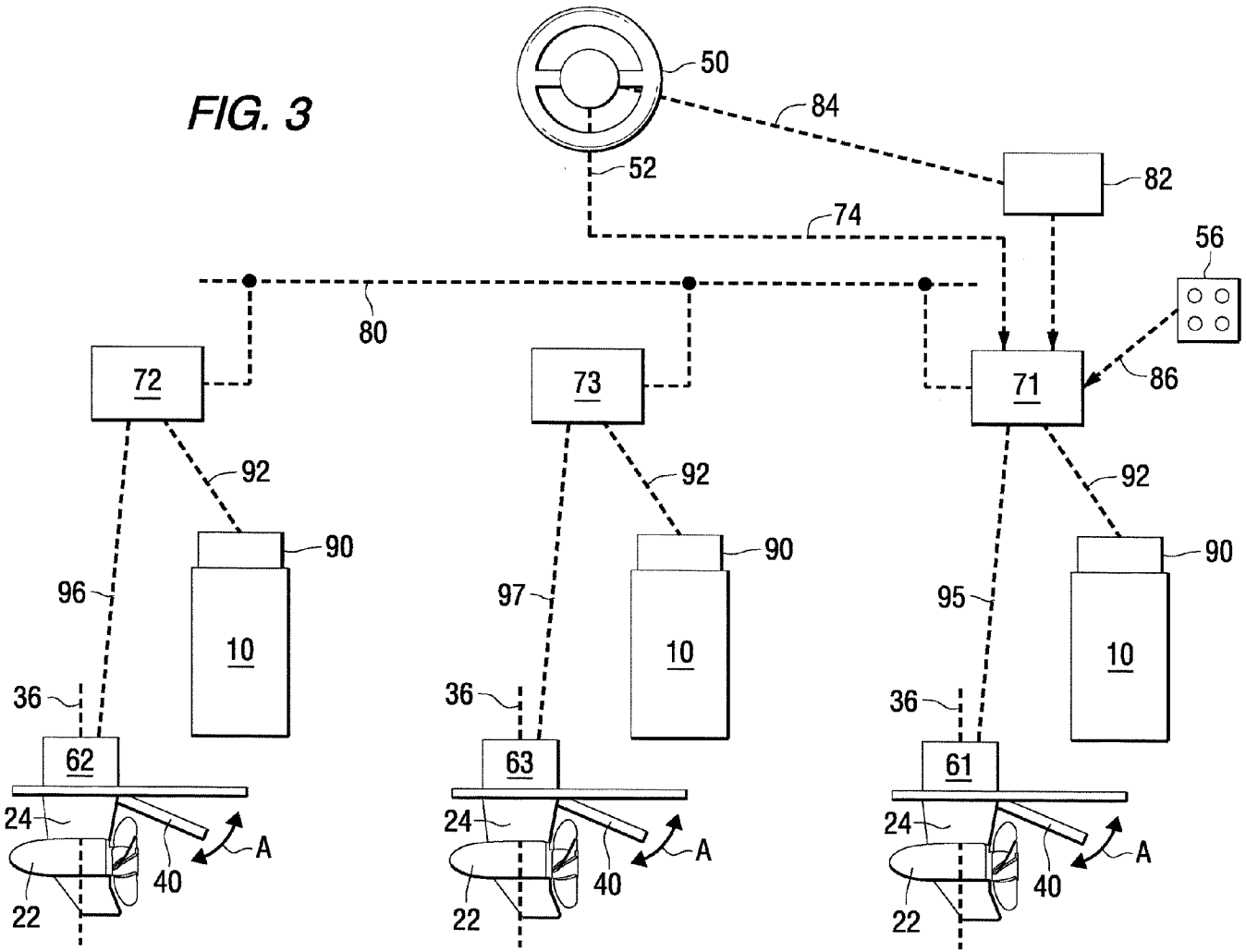

FIG. 1 shows a side view of an actual marine propulsion system on which the present invention can be used. FIGS. 2 and 3 show highly simplified versions of the components illustrated in FIG. 1, but with additional elements of the system also shown. In both FIGS. 2 and 3, two preferred embodiments of the present invention are illustrated and will be described below. FIGS. 2 and 3 illustrate embodiments of the present invention with three drive units, but it should be clearly understood that alternative embodiments could similarly be shown with four or more drive units.

A manually operable device 50, such as a hand operated steering wheel, is provided with a first sensor (e.g. an encoder) that detects its rotational position and provides a first signal which is represented by dashed line 52 in FIGS. 2 and 3. Another manually operable device is a set of switches 56 that allows the operator of a marine vessel to select the position of the trim plates 40. In the illustration, four push buttons are illustrated. These could represent up and down trim switches for the port outside trim plate and the starboard outside trim plate.

With continued reference to FIGS. 2 and 3, a first actuator 61, a second actuator 62, and a third actuator 63 are shown. In the adopted terminology discussed above, the first actuator 61 is the starboard outside actuator, the second actuator 62 is the port outside actuator and the third actuator 63, which is centrally located, is the starboard inside actuator. In a marine propulsion system incorporating four drive units, a fourth drive unit would be the port inside drive unit and its actuator would be the port inside actuator. If these actuators are steering actuators, they could be hydraulic rotational actuators that are configured to cause the driveshaft housing 24 and gear case 22 to rotate about the associated generally vertical steering axis 36 for their associated drive unit.

Also shown in FIGS. 2 and 3 are a first controller 71, a second controller 72, a third controller 73. These represent the starboard outside controller 71, the port outside controller 72, and the starboard inside controller 73. If four propulsion units are used, a fourth controller would represent the port inside controller.

Preferred embodiments of the present invention will be described below in terms of a steering control system and a trim plate control system. Many features of these two control systems are similar to each other. With reference to the steering control system, the first signal on line 52 is shown in FIG. 2 as being connected in signal communication with the first and second controllers, 71 and 72. These connections are accomplished by the illustrated dashed lines 74 and 76. A communication bus 80 is provided on the marine vessel for the purpose of allowing various devices and microprocessors to communicate with each other. A communication bus that is suitable for use for these purposes is described in detail in U.S. Pat. No. 6,273,771. It utilizes a CAN (controller area network) which is well known to those skilled in the art and was developed by the Bosch Corporation. A communication network like that represented by dashed line 80 in FIGS. 2 and 3 allows the first, second and third controllers, 71-73, to communicate directly with each other. As a result, signals received by either the first or second controllers, 71 or 72, can be communicated to other controllers. The first controller 71 can receive the first signal 52, on line 74, and then transmit appropriate control signals to the second and third controllers, 72 and 73. The control signals need not be identical to the first signal provided on line 52. Instead, the control signals provided to the second and third controllers can be mathematically manipulated in order to cause the first, second, and third actuators, 61-63, to behave differently from each other. The reasons for this difference in control signals to the different actuators will be described in greater detail below.

With continued reference to FIGS. 2 and 3, a second sensor 82 can be provided in certain embodiments of the present invention to receive a second signal, as represented by dashed line 84, which provides redundancy for the first signal on line 52. Both of these signals can represent the rotational position of the manually operable device 50 which, in this case, is a steering wheel.

It should be noted that the illustration in FIG. 3 differs from that in FIG. 2 in relation to the transmission of the first signal on line 52. In FIG. 3, the first signal is only transmitted directly from the manually operable device 50 to the first controller 71. It is not transmitted in parallel to the second controller 72 as illustrated in FIG. 2. Different applications of the present invention can be configured in either of these two optional ways. The arrangement in FIG. 2 provides additional redundancy by connecting the first signal, on line 52, to the second controller 72 through line 76 in addition to the connection provided by line 74 to the first controller 71. In the event that a problem arises with respect to either of these two connections, the other connection can be used. As an example, in the arrangement shown in FIG. 2, if the connection represented by dashed line 74 is broken, the connection provided by line 76 can transmit its signal to the second controller 72 which, in turn, can transmit that signal on the signal bus 80 to the first and third controllers, 71 and 73. In both arrangements, the third controller 73 relies on either the first or second controllers, 71 or 72, to provide the signal received on line 52 regarding the position of the manually operable device 50, or steering wheel.

With continued reference to FIGS. 2 and 3, the signal provided on line 84 can be an analog signal which varies from zero to five volts and which represents the angular position of the steering wheel 50. The signal provided on line 52 can be an encoder signal associated with the first sensor. The encoder signal would also provide information (i.e. the first signal) identifying the rotational position of the steering wheel 50.

In the embodiment of the present invention shown in FIGS. 2 and 3, the trim command switches 56 are shown connected only to the first controller 71 as represented by dashed line 86. That signal, which represents a desired change in position of the trim plates 40, is then transmitted to the second and third controllers, 72 and 73, on the serial communication bus 80. The trim switches 56, in a preferred embodiment of the present invention, are not provided with the same degree of redundancy as are the steering signals which are transmitted on both lines 52 and 84 for a first degree of redundancy and subsequently on lines 74 and 76 in the embodiment shown in FIG. 2 followed by a transmission of the signals on the communication bus 80 to the other controllers.

In FIGS. 2 and 3, the engines 10 are shown with a System Integration Module (SIM) which provides signals to help control their operation. Since those signals used by the SIM are not directly related to preferred embodiments of the present invention, they will not be described in detail herein. However, they are represented by the rectangular box 90 associated with each engine 10 and the dashed line 92 which is representative of a communications link that allows the SIM to receive signals that are provided on the bus 80 from a device, such as a plurality of throttle handles. Also shown in FIG. 2 are dashed lines 95-97 which illustrate, respectively, the communication links between the first, second, and third controllers, 71-73, and the first, second, and third actuators, 61-63. Although illustrated in a simple schematic way in FIGS. 2 and 3, it should be understood that the first, second, and third actuators, 61-63, are used to represent the appropriate actuators which either cause the driveshaft housing 24 to rotate about the steering axis 36 or cause the trim plate 40 to rotate about its generally horizontal axis 42 described above in conjunction with FIG. 1. Those skilled in the art of marine propulsion systems are familiar with various types of actuators that can be used as steering actuators and those which can be used as trim plate actuators. Steering actuators could be hydraulic rotational actuators that are particularly configured to operate as hydraulic motors with the necessary hydraulic pistons and swashplates to accomplish the steering maneuvers. The trim plate actuators can be hydraulic cylinders that provide the necessary force to move the trim plate 40 about its generally horizontal axis of rotation which is described above in conjunction with FIG. 1 and identified by reference numeral 42.

In both preferred embodiments of the present invention, relating to steering and trim plate actuation, it should be understood that the movement of each of the three actuators need not be identical to the other two actuators. Based on a single steering signal on line 52, for example, the three marine propulsion units can each be commanded to rotate about its individual steering axis 36 by a different angular magnitude. Similarly, the movement of the port outside trim plate and starboard outside trim plate may necessitate an angular movement A of the starboard inside trim plate and/or the port inside trim plate by a magnitude that differs from either the starboard or port outside trim plates. This will be described in greater detail below. Also, a movement of the steering wheel 50 can provide a first signal on line 52 which necessitates a different angular rotation of each of the three propulsion units about its individual vertical steering axis 36. This will also be described in greater detail below.

Figure 4:
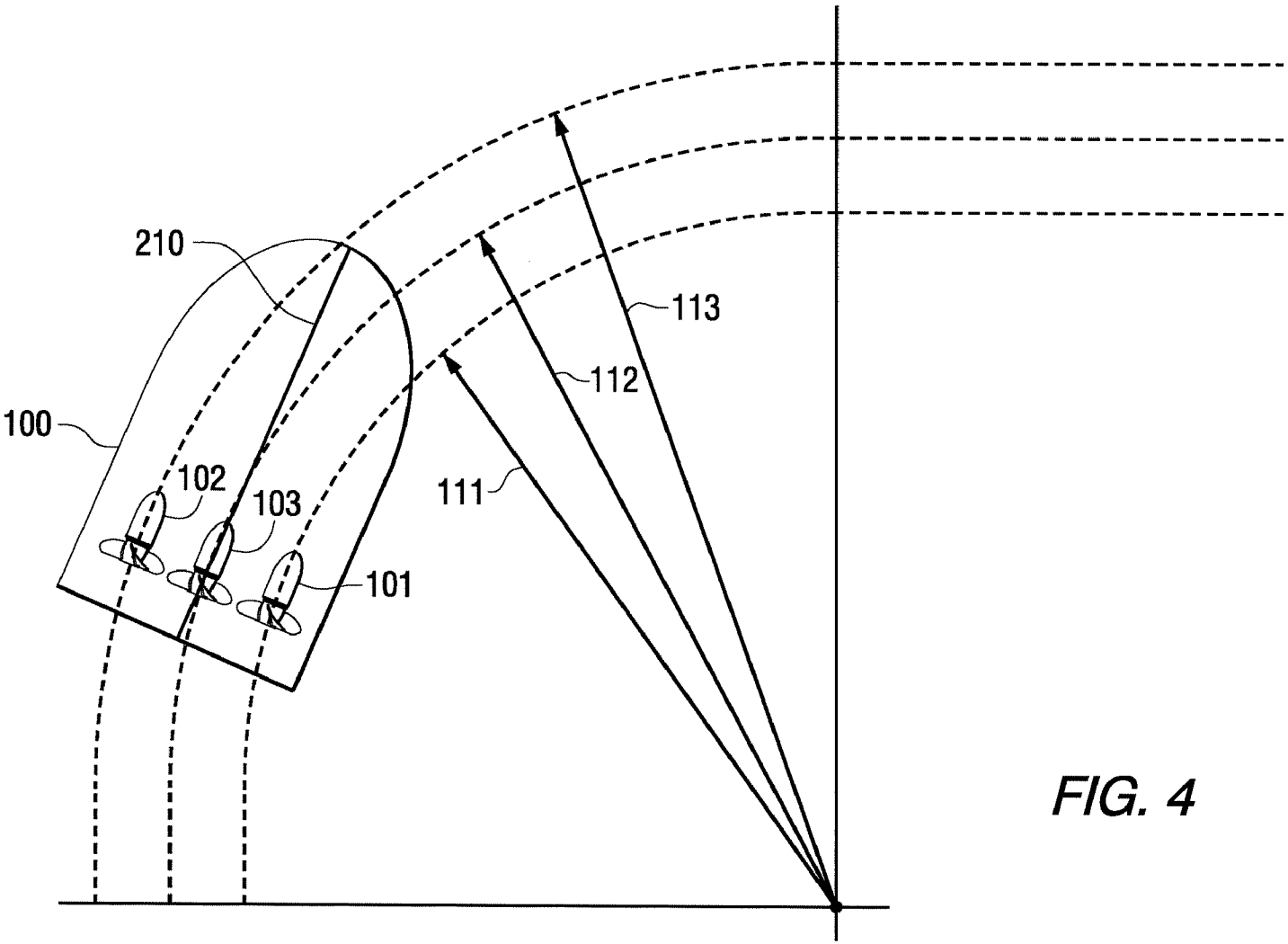
FIG. 4 is a graphical representation of a steering maneuver of a marine vessel with three propulsion units.

FIG. 4 illustrates a situation that is referred to generally as the Ackerman Steering Principle. This principle is usually used in conjunction with land vehicles and is applicable when the land vehicle is turning. It particularly relates to the fact that when a vehicle is turning, its inside wheel can be turned at a greater angle than the outside wheel in order to reduce unwanted heat caused by friction in addition to wear of the tires. FIG. 4 illustrates the Ackerman Principle in association with a marine vessel 100. The marine vessel 100 is shown with three propulsion devices, 101-103. When turning around a bend, as represented by the three dashed lines in FIG. 4, the three drives move along paths which have different turning radii, 111-113, respectively. In order to cause the three drive units to track most efficiently along their respective paths through the water, they can be turned at different angles relative to the marine vessel 100. Although less critical than in land vehicle applications, application of the Ackerman Steering Principle can benefit both the efficiency of operation and handling of a marine vessel with a plurality of propulsion units. When a steering wheel of a marine vessel is turned, certain embodiments of the present invention can interpret the first signal, on line 52 in FIGS. 2 and 3, differently for each of the three controllers, 71-73. By selecting the steering angle of each of the drive units according to the Ackerman Steering Principle, efficiency and handling can be improved. The specific geometry and calculations associated with the determination of the steering angles based on the Ackerman Steering Principle will not be described in detail herein. These relationships are well known to those skilled in the art and have been applied to land vehicles since originally developed in the $19^{th}$ century by Mr. Rudolph Ackerman. In a preferred embodiment of the present invention, the turning radii, 111-113, for each of the drive units can be calculated or determined from a lookup table and the commands to each of the steering actuators can be determined individually.

Figures 5, 6:
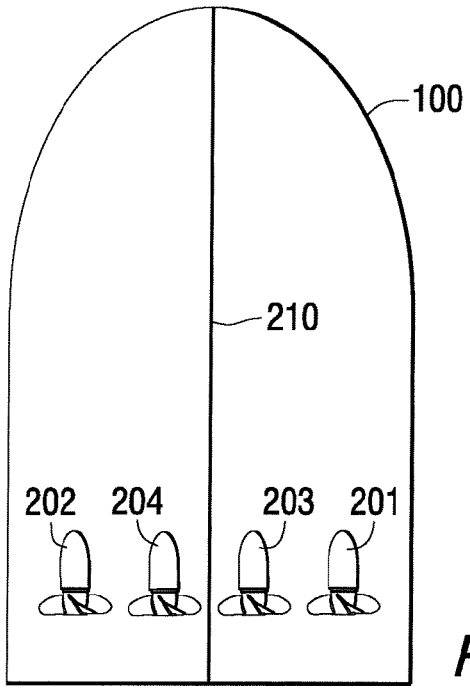
FIG. 5 is a table with a plurality of steering angles stored as a function of boat speed and steering wheel rotation.
FIG. 6 is a schematic representation of a marine vessel with four drive units.

Another advantage of the preferred embodiment of the present invention is that it easily facilitates the use of different magnitudes of rotation for each of the drive units, about their individual generally vertical steering axes 36, as a function of boat speed and wheel rotation of the manually operable steering wheel 50. In FIG. 5, a lookup table is shown that can serve these purposes. In the exemplary table shown in FIG. 5, boat speed is represented in increments of 10 miles per hour from zero to 40 miles per hour. Naturally, other speed ranges and incremental values can be used. The table also divides the wheel rotation from zero to 180 degrees in 20 degree increments. Although specific numbers are not shown in the table of FIG. 5, each cell would represent an angular rotation of a drive unit. Each of the drive units could be provided with a separate lookup table or, alternatively, they could be steered to the same angle or be based on variations of an angle represented in the cells of the table. In other words, the magnitude stored in a particular cell of the table could represent the angular rotation of the center drive unit and the port and starboard outside units would be calculated as a variation from that number in the table. The primary purpose of the use of a table such as shown in FIG. 5 is to allow more comfortable control of a marine vessel at different speeds. As an example, at very low boat speeds a certain rotation of the steering wheel may result in a larger magnitude of rotation of the drive units than would occur when the boat speed is higher. At high speeds, less rotation turning of the drive units would occur for a particular angle of rotation of the steering wheel. This would facilitate better control.

Figure 7:
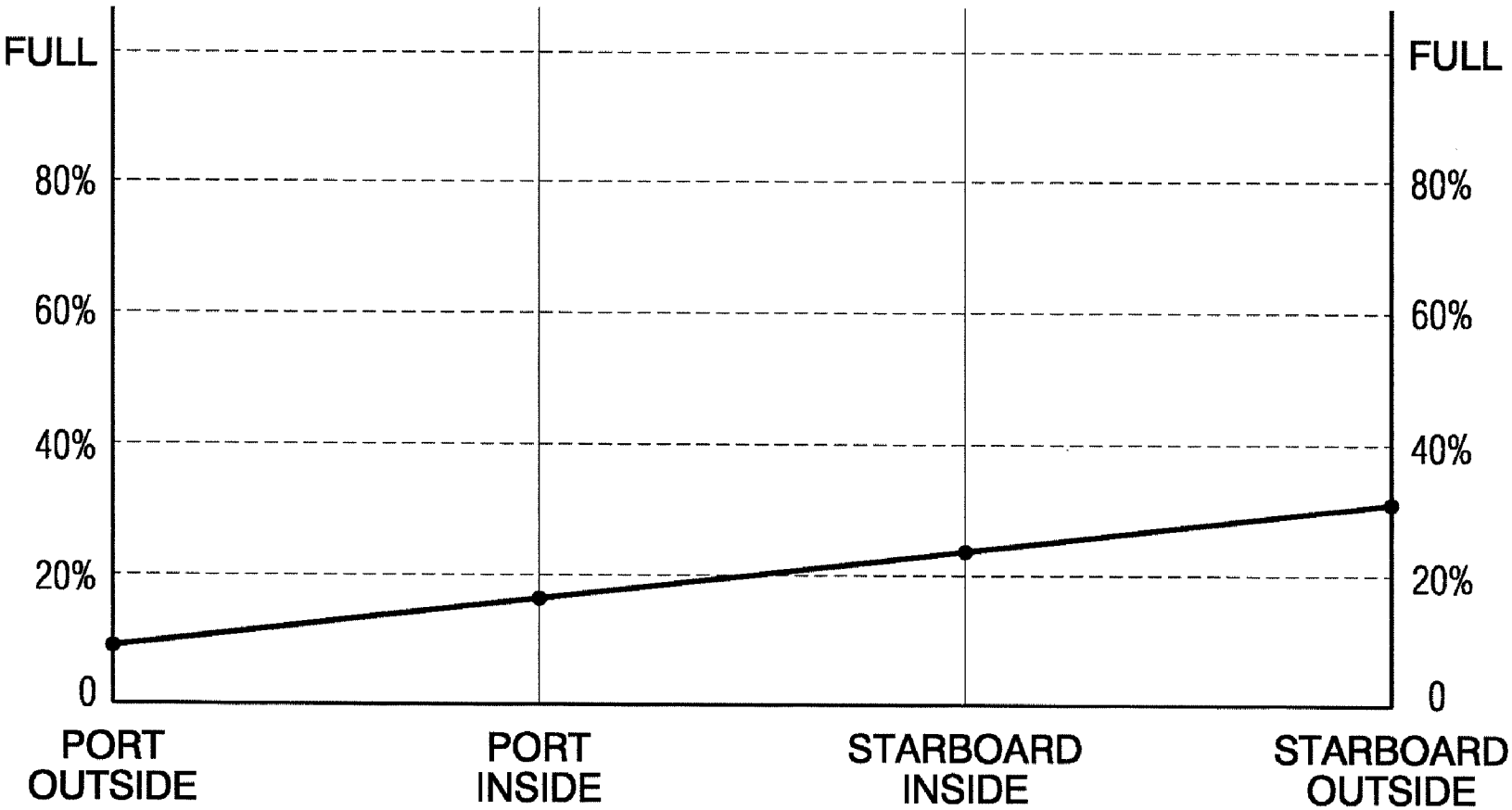
FIG. 7 is a graphical representation showing a theoretical combination of trim angles for four trim plates of a marine vessel.

FIG. 6 is a schematic representation of a marine vessel 100 with four drive units in which each of the drive units is generally similar to the structure shown in FIG. 1, wherein the driveshaft extends downwardly through the hull of the marine vessel 100. According to the terminology adopted in the above discussion, the four drive units identified by reference numerals 201-204 would be the starboard outside drive unit 201, the port outside drive unit 202, the starboard inside drive unit 203, and the port inside drive unit 204. Although the basic principles described above as the Ackerman Steering Principles would apply to four drive units in a manner that is generally similar to the application of these principles to three drive units, the control of trim plates for a marine vessel with four trim plates can be significantly different than the basic principles under which a marine vessel with three trim plates is controlled. More specifically, when the trim plates are attached to the drive units, as illustrated in FIG. 1, a marine vessel with three drive units would probably have its center trim plate located at the middle or keel position. The keel is identified by reference numeral 210 in FIG. 6 and in FIG. 4. If a trim plate is located at the keel position as is the case when three drive units are provided, actuation of the trim plate has virtually no effect on the level of the marine vessel. The port outside trim plate and starboard outside trim plate can be effective in raising or lowering the port and starboard sides of the boat, but the middle trim plate, or starboard inside trim plate, would have virtually no effect except to raise or lower the bow. In a system that has four trim plates, however, the leveling of the boat can be significantly enhanced with finer control through the application of the preferred embodiments of the present invention. Based on the manually commanded positions of the port outside trim plate and starboard outside trim plate, the positions of the port inside trim plate and starboard inside trim plate can be mathematically derived to improve the leveling of the watercraft. These basic principles are illustrated in FIG. 7. A graphical representation shows the relationships among the trim angles of the four trim plates.

In the example shown in FIG. 7, the starboard outside trim plate is moved to a position that is 30% of its full travel. The port outside trim plate is positioned at 10% of its full travel. In this basic example, the controllers of the port inside trim plate and starboard inside trim plate could command associated actuators to assume intermediate angles that assist in achieving the level position that the operator of the marine vessel is attempting to achieve by commanding the port outside trim plate to 10% of full travel and starboard outside trim plate to 30% of full travel. The result would be a movement of the port inside trim plate to 16.67% of full travel and the starboard inside trim plate to 23.33% of it full travel. These transitional inside positions, in a typical application, would assist the outside trim plates in achieving the desired position of the marine vessel. Naturally, alternative algorithms can be developed as a result of the flexibility provided by the preferred embodiments of the present invention.

Figure 8:
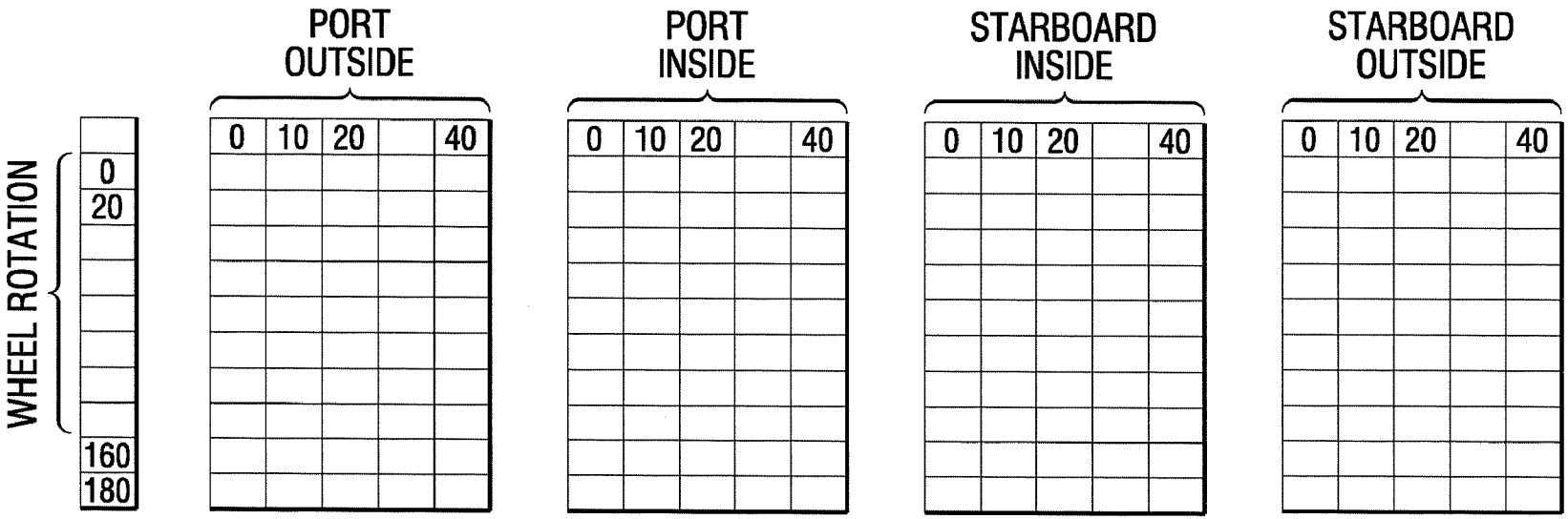
FIG. 8 shows a variation of the table shown in FIG. 5, but for a marine vessel with four drive units.

In conjunction with FIG. 5, the relationships between the magnitude of rotation of the steering wheel 50 and the magnitude of rotation of the drive units were described in conjunction with a table in which the cells contained drive unit rotation magnitudes as a function of both boat speed and wheel rotation. FIG. 8 shows this similar concept applied to four drive units which are each independently steerable about their individual vertical steering axes. For a particular wheel rotation, represented at the left of FIG. 8, four individual tables contain the associated magnitude of rotation of the drive units. The arrangement of tables shown in FIG. 8 is applicable for a marine vessel such as that illustrated in FIG. 6 which has four drive units, 201-204.

With continued reference to FIGS. 1-8, several preferred embodiments of the present invention have been described. Common among these various preferred embodiments are a manually operable device, a first sensor configured to detect the position of the manually operable device and provide a first signal which is representative of that position, first, second, and third actuators, and first, second, and third controllers. Alternative embodiments are also described above in which a fourth actuator and a fourth controller are used. It should be understood that the specific number of actuators and controllers is not limiting to the basic concepts of the present invention. The first controller is connected in signal communication with the first actuator, the second controller is connected in signal communication with the second actuator, and the third controller is connected in signal communication with the third actuator. The actuators can be steering actuators such as hydraulic steering actuators or trim tab actuators which can incorporate hydraulic cylinders. The first controller 71 is configured to receive the first signal on lines 52 and 74 and provide control signals to the second and third controllers, 72 and 73, in response to receipt of that first signal. In certain applications of the present invention, a second sensor can be configured to detect the position of the manually operable device, such as the steering wheel 50, and provide a second signal 84 that is representative of that rotational position. Alternatively, signals can be provided by trim switches 56 on line 86 and subsequently transmitted between the various controllers, 71-73. In certain embodiments of the present invention, the first controller 71 is configured to receive the first signal 52 and in other embodiments, both the first and second controllers, 71 and 72, are connected in such a way that they receive the same first signal 52 through parallel connections. The reasons for these alternative connection schemes are described above and relates to the advantages of redundancy. Similarly, a redundant signal on line 84 can be provided. When the second controller 72 is also configured to receive the first signal on lines 52 and 76, it can subsequently transmit that signal to the first and third controllers, 71 and 73, on the serial bus 80. The third controller 73 in a preferred embodiment of the present invention, as shown in FIG. 2, can be configured to alternatively receive control signals from the first and second controllers, 71 and 72. As shown in FIGS. 2 and 3, the first, second, and third controllers, 71-73, can be connected in signal communication with a common signal bus 80. The third controller 73 can be configured to control the third actuator 63 in conformance with the control signals which are derived as a function of the first signal on line 52 in conformance with which the first actuator 61 is controlled by the first controller 71. The actuation caused by the controllers need not be identical for all of the drive units. In other words, the movement of each of the three trim plates 40 shown in FIGS. 2 and 3 can differ from each other. In the case of trim plate actuation, the selection of these angular magnitudes can be achieved in the manner described above in conjunction with FIG. 7. In the case of the steering actuation control, the steering angles can be controlled with lookup tables as described above in conjunction with FIG. 8. Various embodiments of the present invention allow these alternative designs to be actually included in various types of systems.

With continued reference to FIGS. 1-8, it should be understood that important aspects of the preferred embodiments of the present invention include the optional connection of only one of the controllers, 71-73, to the first sensor by lines 52 and 74 as shown in FIG. 3. The second and third controllers, 72 and 73, need not be connected to the first sensor because they can receive signals indirectly from the first controller 71. Even in situations where both the first and second controllers are connected to the first sensor by lines 52, 74 and 76, failure or inoperability of either of these two signal connections can be responded to through the use of the alternative connection. In both of these embodiments, the third controller 73 obtains its control signals from another controller and not from the first sensor directly.

Although the present invention has been particularly described to illustrate several preferred embodiments, it should be understood that alternative embodiments are also within its scope.

We claim:

1. A marine propulsion control system, comprising:

a manually operable device;

a first sensor configured to detect a position of said manually operable device and provide a first signal which is representative of said position of said manually operable device;

a first actuator, a second actuator, and a third actuator; and a first controller connected in direct signal communication with said first actuator, a second controller connected in signal communication with said second actuator, and a third controller connected in signal communication with said third actuator, wherein said first controller is configured to receive said first signal and provide control signals to said second and third controllers in response to receipt of said first signal from said first sensor.

2. The system of claim 1, wherein:

said first actuator is a first steering actuator, said second actuator is a second steering actuator, and said third actuator is a third steering actuator.

3. The system of claim 1, wherein:

said first actuator is configured to cause an outside port propulsion drive to rotate about a first generally vertical steering axis, said second actuator is configured to cause an outside starboard propulsion drive to rotate about a second generally vertical steering axis, and said third actuator is configured to cause an inside starboard propulsion drive to rotate about a third generally vertical steering axis.

4. The system of claim 1, wherein:

said manually operable device is a hand operated steering wheel.

5. The system of claim 1, further comprising:

a second sensor configured to detect said position of said manually operable device and provide a second signal which is representative of said position of said manually operable device, wherein said first controller is configured to receive said second signal and provide said control signals to said second and third controllers in response to receipt of said second signal from said second sensor.

6. The system of claim 1, wherein:

said second controller is configured to receive said first signal.

7. The system of claim 1, wherein:

said second controller is configured to receive said first signal and provide a control signal to said third controller in response to receipt of said first signal from said first sensor.

8. The system of claim 1, wherein:

said third controller is configured to alternatively receive control signals from said first and second controllers.

9. The system of claim 1, wherein:

said first, second, and third controllers are all connected in signal communication with a common signal bus.

10. The system of claim 1, wherein:

said third controller is configured to control said third actuator in conformance with said control signals which are derived as a function of said first signal in conformance with which said first actuator is controlled by said first controller.

11. A marine propulsion control system, comprising:

a manually operable steering device;

a first sensor configured to detect a rotational position of said manually operable steering and provide a first signal which is representative of said rotational position of said manually operable steering;

a first steering actuator, a second steering actuator, and a third steering actuator; and a first steering controller connected in direct signal communication with said first steering actuator, a second steering controller connected in direct signal communication with said second steering actuator, and a third steering controller connected in direct signal communication with said third steering actuator, wherein said first steering controller is configured to receive said first signal and provide control signals to said second and third steering controllers in response to receipt of said first signal from said first sensor.

12. The system of claim 11, wherein:

said second steering controller is configured to receive said first signal and provide a control signal to said third steering controller in response to receipt of said first signal from said first sensor.

13. The system of claim 12, wherein:

said second steering controller is configured to receive said first signal.

14. The system of claim 13, wherein:

said first steering actuator is configured to cause an outside port propulsion drive to rotate about a first generally vertical steering axis, said second steering actuator is configured to cause an outside starboard propulsion drive to rotate about a second generally vertical steering axis, and said third steering actuator is configured to cause an inside starboard propulsion drive to rotate about a third generally vertical steering axis.

15. The system of claim 11, further comprising:

a second sensor configured to detect said rotational position of said manually operable steering and provide a second signal which is representative of said rotational position of said manually operable steering, wherein said first steering controller is configured to receive said second signal and provide said control signals to said second and third steering controllers in response to receipt of said second signal from said second sensor.

16. The system of claim 11, wherein:

said first, second, and third steering controllers are all connected in signal communication with a common signal bus.

17. The system of claim 16, wherein:

said third steering controller is configured to alternatively receive control signals from said first and second steering controllers.

18. The system of claim 11, wherein:

said third steering controller is configured to control said third steering actuator in conformance with said control signals which are derived as a function of said first signal in conformance with which said first steering actuator is controlled by said first steering controller.

19. A marine propulsion control system, comprising:

a manually operable steering device;

a first sensor configured to detect a rotational position of said manually operable steering device and provide a first signal which is representative of said rotational position of said manually operable steering device;

a first steering actuator, a second steering actuator, and a third steering actuator; and a first controller connected in direct signal communication with said first steering actuator, a second controller connected in direct signal communication with said second steering actuator, and a third controller connected in direct signal communication with said third steering actuator, wherein said first controller is configured to receive said first signal and provide control signals to said second and third controllers in response to receipt of said first signal from said first sensor, said first steering actuator being configured to cause an outside port propulsion drive to rotate about a first generally vertical steering axis, said second steering actuator being configured to cause an outside starboard propulsion drive to rotate about a second generally vertical steering axis, and said third steering actuator being configured to cause an inside starboard propulsion drive to rotate about a third generally vertical steering axis, said third controller being configured to control said third steering actuator in conformance with said control signals which are derived as a function of said first signal in conformance with which said first steering actuator is controlled by said first controller, said first, second, and third controllers being connected in signal communication with a common signal bus.

20. The system of claim 19, further comprising:

a second sensor configured to detect said rotational position of said manually operable steering device and provide a second signal which is representative of said rotational position of said manually operable steering device, wherein said first controller is configured to receive said second signal and provide said control signals to said second and third controllers in response to receipt of said second signal from said second sensor, said second controller being configured to receive said first signal, said second controller being configured to receive said first signal and provide a control signal to said third controller in response to receipt of said first signal from said first sensor, said third controller being configured to alternatively receive control signals from said first and second controllers.

* * * * *